US005457905A

United States Patent [19]

Kaplan

[11] Patent Number: 5,457,905

[45] Date of Patent: Oct. 17, 1995

[54] WINDOW ASSEMBLY FOR MENU BOARD

[75] Inventor: Paul Kaplan, East Northport, N.Y.

[73] Assignee: International Patterns Incorporated, Deer Park, N.Y.

[21] Appl. No.: 251,397

[22] Filed: May 31, 1994

[51] Int. Cl.[6] ..... G09F 13/04

[52] U.S. Cl. ..... 40/574; 40/611

[58] Field of Search ..... 40/568, 574, 575, 40/576, 585, 611, 572

[56] References Cited

U.S. PATENT DOCUMENTS

| | | | |
|---|---|---|---|
| 1,834,423 | 12/1931 | Rider | 40/585 X |
| 2,318,596 | 5/1943 | Davenport | 40/576 X |
| 4,021,949 | 5/1977 | Niehaus et al. | 40/132 X |
| 4,587,754 | 5/1986 | Ossner | 40/575 X |
| 5,174,056 | 12/1992 | King | 40/574 X |
| 5,353,536 | 10/1994 | Erber et al. | 40/611 X |

FOREIGN PATENT DOCUMENTS

| | | | |
|---|---|---|---|
| 1575609 | 9/1980 | United Kingdom | 40/611 |

*Primary Examiner*—Kenneth J. Dorner
*Assistant Examiner*—James O. Hansen
*Attorney, Agent, or Firm*—Schweitzer Cornman & Gross

[57] ABSTRACT

A menu board assembly comprising a frame for displaying artwork, having a series of frame elements joined together to define the side walls of a generally parallelepiped recess. The frame is superimposed on a light box having a transparent face plate forming the rear wall of a cavity and a transparent window plate is positioned to cover the recess and is superimposed on the front of the face plate. A flexible tape connects the window plate with said face plate for pivotal movement and defines a bight at the hinge. The window plate may be pivoted from a bight-opening position to a bight-closing position to accommodate the insertion or removal of artwork.

11 Claims, 2 Drawing Sheets

FIG. 4
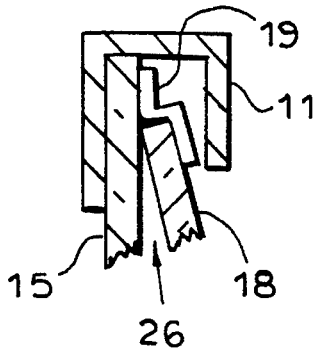
FIG. 3
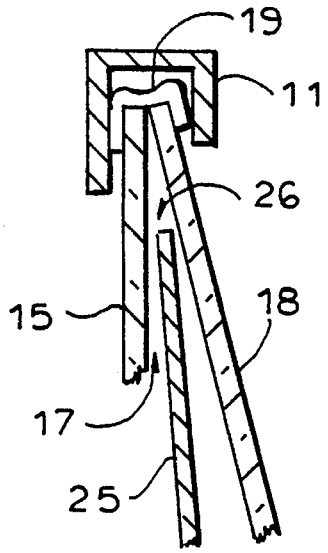
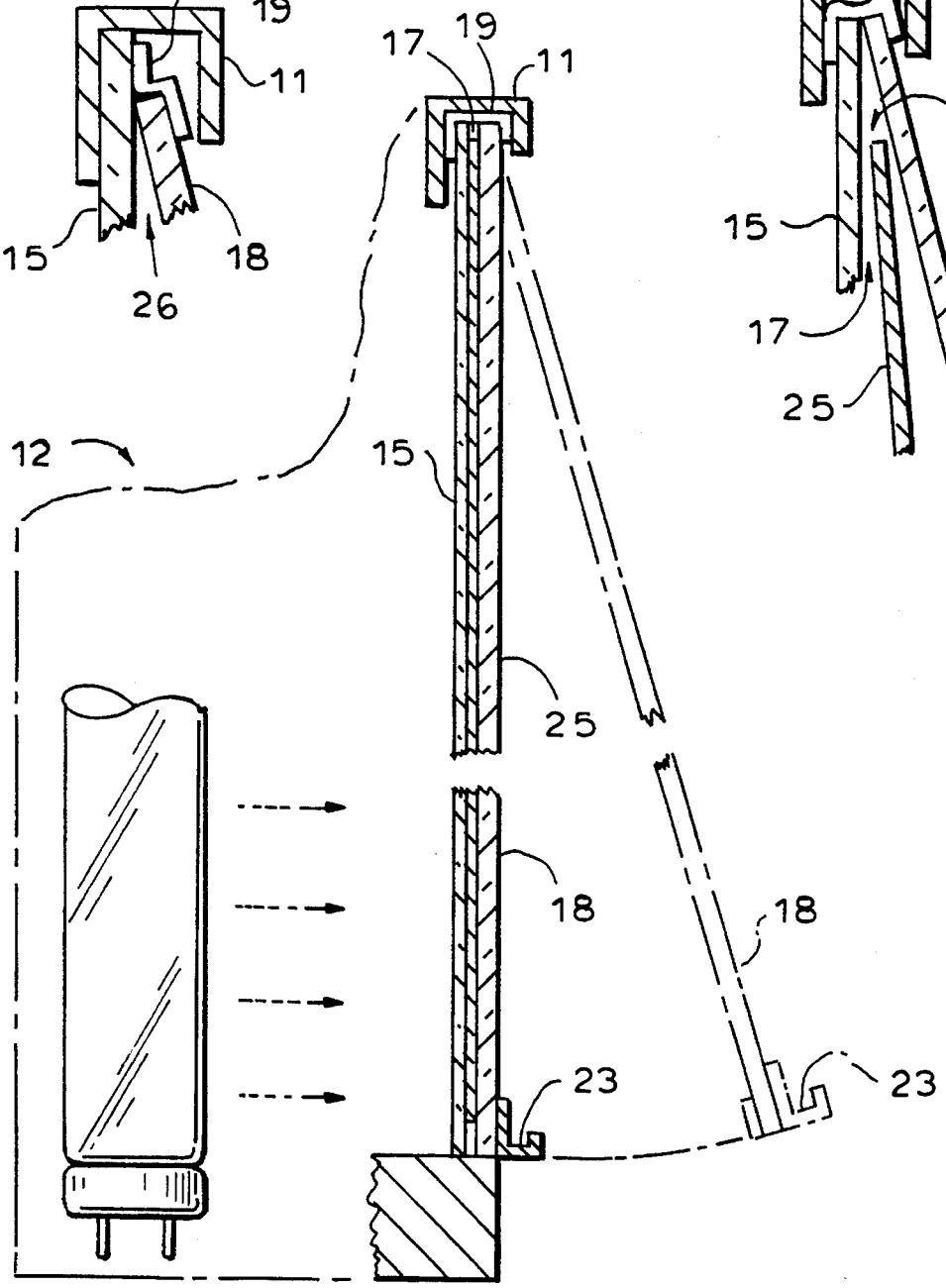
FIG. 2

WINDOW ASSEMBLY FOR MENU BOARD

BACKGROUND AND SUMMARY OF THE INVENTION

Changeable menu boards are well known to the art. Such menu boards typically include provisions for changing the items listed on the menu and/or the prices as well as providing for changing graphic displays associated with the menu board.

However, the changing of photographs, transparencies, or other artwork on menu boards has often been a complicated task requiring total or partial disassembly of the entire menu board.

The present invention provides for the first time a new and improved menu board in which graphics in the form of photographs or transparencies may be quickly and readily replaced from the front of the menu board without removing the menu board from the wall or otherwise interfering with the integrity of the menu board. Specifically, in accordance with the invention a hinged transparent window is established as part of the menu board in any area thereof in association with a light box having a transparent or translucent front face. In accordance with the principles of the present invention, a photograph or transparency is quickly and easily sandwiched between the backlighted support plate of the menu board and the hinged window to maintain the artwork in place. When it is desired to remove or to change the artwork, the window is simply opened by pivoting it about its hinge axis, removing the existing artwork, replacing it with the new artwork to be displayed, and reclosing the window. One or more of the new windows may be formed in a menu board.

For a more complete understanding of the present invention and the benefits to be obtained from its practice, reference should be made to the following detailed description of the invention taken in conjunction with the accompanying drawings.

DESCRIPTION OF THE DRAWINGS

FIG. 2 is a cross-sectional view of the face of the new menu board showing details of construction;

FIG. 3 is an enlarged fragmentary view of one hinging arrangement for the new window construction; and FIG. 4 is an enlarged alternative hinging arrangement.

DETAILED DESCRIPTION OF THE INVENTION

Figure 1:
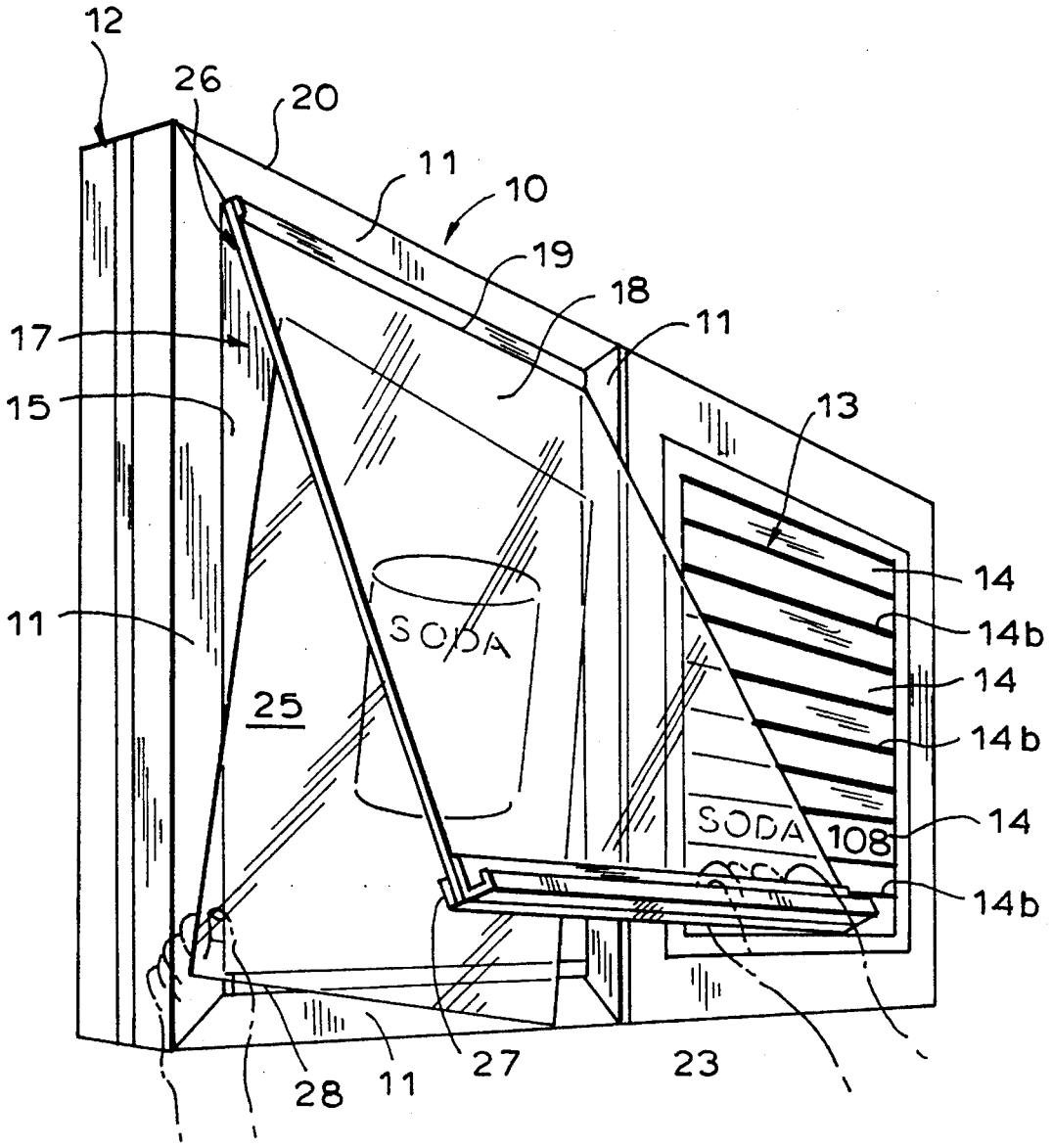
FIG. 1 is a perspective view of the improved menu board of the present invention incorporating the new window construction.

With reference to FIG. 1, the new menu board includes a menu board frame 10 comprising a light box generally indicated by reference numeral 12 and a changeable menu board section 13 in which various menu items may be displayed by flexible changeable plastic strips 14 which may be inserted in and removed from strip retaining moldings **14*b* incorporated into the frame. If desired, the changeable strips 14** may be of the form described in greater detail in application for "Improved Menu Board Assembly," Ser. No. 232,751, filed Apr. 22, 1994 or "Improved Lighted Menu Board Assembly," Ser. No. 232,626, filed Apr. 22, 1994, the disclosures of which co-pending applications are incorporated by reference herein.

As shown in FIG. 2, the light box 12 includes a transparent or translucent diffuser face plate 15 which is mounted in and bordered on its edges by the frame rails 11, the inner edges of which define a rectangular transparency-receiving recess 17. In accordance with the principles of the present invention, a transparent glass or clear acrylic plastic front window plate 18, the same size and shape as the recess 17, is hingedly secured by a hinge 19, advantageously a fabric adhesive tape or a flexible plastic adhesive tape, attached to the upper edge of the plate 18 at the top of the recess.

As shown in FIG. 1, the upper frame element 11 is part of the menu board frame 20. Affixed to the lowermost lateral portions of the plate 18 is an elongated handle extrusion 23 which may be grasped to pivot the window plate 18 toward and away from the back lighted diffuser plate 15. In accordance with the principles of the invention, artwork 25 in the form of a transparency may be readily inserted into the recess 17 or removed therefrom by grasping the extrusion handle 23, opening the window plate 18, inserting the artwork into the bight 26 formed between the hinged portions of the diffuser face plate 15 and the window plate 18, closing the window plate to sandwich the artwork 25 between the face plate 15 of the light box and the hinged window plate 18. Thus, transparencies or other artwork may be readily inserted or changed without any difficulty whatever, any disassembly of the fundamental menu board sign, or removal of the sign from its place of display on a wall or otherwise. To hold the window plate 18 securely in its closed position, a magnetic strip or tape 27 is applied by adhesive to the lower edges of the window plate 18 for cooperation with a ferrous strip 28 adhered to the outside of the face plate 15 as shown in FIG. 1. Alternatively, the magnetic strip and the ferrous strip may be reversed as will be understood. Advantageously, the strip 28 serves as a locator or alignment edge for the bottom edge of the artwork 25 which is to be displayed when the strip 28 is adhered to the outer surface of the plate 15. In some applications, the strip 28 may be mounted behind the plate 15 in juxtaposition with the strip 27 when the window plate 18 is closed.

In lieu of the magnetic disclosure provided by the cooperating strips 27, 28, the window plate may be proportioned to engage the menu board frame rails 11 in a friction fit or hooked and looped "Velcro" closure elements may be substituted for the strips 27, 28.

While the present invention has been described by way of a particular example, various changes and improvements therein may be made without departing from the spirit and the scope of the present invention as set forth hereinafter in the appended claims.

What is claimed is:

1. A menu board assembly comprising (a) a frame for displaying artwork, said frame comprised of a series of frame elements;

(b) said frame elements joined together to define a generally parallelepiped recess having side walls;

(c) the frame being superimposed on a light box having a transparent or translucent face plate;

(d) said face plate forming a rear wall of said recess;

(e) a transparent window plate positioned to cover said recess and being superimposed on said face plate;

(f) a flexible tape hinge means associating said window plate with said face plate for pivotal movement with respect thereto; said window plate and said face plate defining a bight therebetween at said hinge means;

(g) handle means associated with said window plate remotely of said hinge means;

(h) whereby said handle means may be grasped to pivot said window plate from a bight-opening position to a bight-closing position to accommodate the insertion or removal of a sheet of graphic material therefrom.

2. The menu board assembly of claim 1, in which (a) the bottom edge of said window plate includes holding means to retain said window plate in a bight-closing position.

3. The menu board assembly of claim 2, in which (a) said holding means includes a magnetized strip associated with said bottom edge and a cooperating ferrous strip in juxtaposition therewith.

4. The menu board assembly of claim 3, in which (a) said magnetized strip forms an artwork locating guide.

5. The menu board assembly of claim 1, further including (a) means for retaining changeable indicia for menu items;

(b) a series of changeable menu indicia.

6. The menu board assembly of claim 3, in which (a) said changeable menu indicia are flexible plastic strips.

7. The menu board assembly of claim 3, in which (a) a plurality of flames for said artwork are included in said menu board assembly.

8. A menu board assembly comprising (a) a frame housing a light box having a front face plate;

(b) retaining means associated with said frame for removably mounting menu item indicia to said front face plate;

(c) hinge means associating at least one transparent window plate with said front face plate;

(d) said window plate and said front face plate cooperating to define a display zone for removably mounting transparencies therebetween;

(e) said hinge means being plastic tape adhered to said face plate and to said window plate.

9. The menu board assembly of claim 8, in which (a) said hinge means is disposed along an upper edge of said window plate; and (b) a holding means for retaining said window plate against said front face plate is disposed along a lower edge of said window plate.

10. The menu board assembly of claim 8, in which (a) said hinge means is disposed along a side edge of said window plate; and (b) a holding means is disposed on said window plate opposite said hinge means.

11. The menu board assembly of claim 8, which further includes (a) a handle means secured to said window plate on an outer surface thereof and opposite to said hinge means.

* * * * *